US005946745A

United States Patent [19]

Magee

[11] Patent Number: 5,946,745

[45] Date of Patent: Sep. 7, 1999

[54] PORTABLE SHAMPOO BOWL

[76] Inventor: Harvey Magee, 6223 Fjord Way, New Port Richey, Fla. 34652

[21] Appl. No.: 08/961,774

[22] Filed: Oct. 13, 1997

[51] Int. Cl.[6] ..... A45D 44/08

[52] U.S. Cl. ..... 4/522; 4/516; 4/521

[58] Field of Search ..... 4/515–523

[56] References Cited

U.S. PATENT DOCUMENTS

| | | | |
|---|---|---|---|
| 121,921 | 12/1871 | Winn | 4/515 X |
| 2,850,742 | 9/1958 | Glintz | 4/516 |
| 4,216,551 | 8/1980 | Pasquarello | 4/521 |
| 5,022,102 | 6/1991 | Louvaris | 4/517 X |
| 5,305,481 | 4/1994 | Nebb | 4/518 X |

FOREIGN PATENT DOCUMENTS

| | | | |
|---|---|---|---|
| XL17708 | 1/1956 | Germany | 4/519 |

*Primary Examiner*—Charles E. Phillips
*Attorney, Agent, or Firm*—Stanley M. Miller

[57] ABSTRACT

A hair washing or shampooing device includes a pair of interlocking bowls and a drainage tank that eliminate the need for a conventional sink and which further eliminates the need for a client to bend his or her neck backward during a hair cleaning process. A secondary bowl surmounts a primary bowl and has a greater breadth than the primary bowl so that liquids splashing against the secondary bowl are directed into the primary bowl. A sump formed in the primary bowl is connected by a drainage hose to a drainage tank which may be manually emptied or emptied by a pump. A liquid-delivery hose extends through an opening formed in the secondary bowl, and a liquid-dispensing nozzle having a trigger is attached to the free end of the hose to facilitate the hair-cleaning process. The inner part of a cape is connected to the primary bowl and the outlying part of the cape overlies the client's shoulders to protect them from wetness. A belt member is tightened around the cape to further secure it into position. A drawstring has opposite free ends that may be pulled by the client to further tighten the cape around the client's neck if the client feels that a leakage is imminent. The bowls are supported in part by the client's shoulders and further by a pair of parallel, transversely spaced apart arms that form a part of a height-adjustable stand that at least partially supports the weight of the bowls. The stand accommodates a chair or a bed upon which the client sits during the hair-cleaning procedure.

8 Claims, 5 Drawing Sheets

10

16
15
14
12
48
58
21
47
50
29
18
20
46
42
40
22
45
41
24
43
44A
44B 16
15
14
37
27
52
35
35

37
31
27
23
50
28
25
29
34
53
12
33
21
19
17
50
58
18
33
54
21
34

PORTABLE SHAMPOO BOWL

BACKGROUND OF THE INVENTION

1. Field of the Invention

This invention relates, generally, to devices used for washing or shampooing hair. More particularly, it relates to a portable device that replaces a conventional sink.

2. Description of the Prior Art

Conventional hair washing or shampooing is performed with the use of a sink. Thus, when a client or patient requires hair washing or shampooing at a location not conveniently equipped with a sink, jury-rigged methods are typically used to avoid soaking the clothing of the client or patient during the washing. Even in environments equipped with a sink, the process is uncomfortable to the client and the service provider because the client must bend his or her neck in an uncomfortable position for an extended period of time and the service provider must also bend over and assume various uncomfortable positions for the same amount of time.

There is a need, therefore, for a portable device that would facilitate shampooing and the like in environments lacking a conventional, fixed position sink. There is a further need for a device that would not require the client or the service provider to assume uncomfortable positions for any length of time.

However, in view of the art at the time the present invention was made, it was not obvious to those of ordinary skill in the art how the identified needs could be fulfilled.

SUMMARY OF THE INVENTION

The present invention is a portable hair washing and shampooing device that includes a stand having a base, a vertically disposed height adjustment means, and a pair of transversely disposed arms supported at a first end thereof by the height adjustment means. A primary bowl has a general "U" shape that includes a neck-receiving opening, a bottom wall and upstanding side walls. The upstanding side walls include inner side walls adjacent the neck-receiving opening and outer side walls disposed in spaced relation to the inner side walls. The primary bowl is positioned atop a client's shoulders and atop the pair of transversely disposed arms and is at least partially supported by the transversely disposed arms of the stand.

A secondary bowl has a general "U" shape that includes a neck-receiving opening, a bottom wall and upstanding side walls. The upstanding side walls of the secondary bowl include inner side walls adjacent the neck-receiving opening and outer side walls that flare radially outwardly in spaced relation to the inner side walls. The side walls have lower ends that correspond in shape to upper ends of the upstanding side walls of the primary bowl so that when the secondary bowl is positioned atop the primary bowl, the lower ends of the secondary bowl side walls releasably engage a free upper end of the upstanding side walls of the primary bowl. An opening is formed in the secondary bowl at a preselected location, and an elongate liquid supply hose extends through the opening. A hand-held spray nozzle for applying a liquid to hair is secured to the free end of the hose, and the other end of the hose is in fluid communication with a source of liquid under pressure.

A sump means is formed in the primary bowl, and an elongate drainage hose is disposed in fluid communication between the sump means and a drainage tank. Accordingly, liquid applied to the hair of a client whose neck is received within the neck-receiving opening is directed by the secondary bowl into the primary bowl and flows from the sump means into the drainage tank. Thus, no sink is required to perform a hair washing or shampooing procedure, the client need not bend his or her neck during the procedure, and a service provider performing the procedure need not bend over to the level of a sink.

A flexible, waterproof cape means is worn about the neck of the client whose hair is to be cleaned. The cape has an outlying part positioned in overlying relation to the client's shoulders, and includes a downwardly depending wall that encircles the client's neck. A belt means overlies the downwardly depending wall so that the belt means may be comfortably tightened about the client's neck to prevent fluid leakage.

To attach an inner part of the cape to the primary bowl, a plurality of detents are formed in the inner upstanding side walls of the primary bowl at preselected locations adjacent the neck-receiving opening of the primary bowl and a malleable padded wire is snap fittingly engaged to the plurality of detents at spaced locations along its length. In this way, the inner part of the cape is sandwiched between the upstanding side walls of the primary bowl and the malleable padded wire.

An auxiliary tightening means is also provided to enable the client to further tighten the cape to prevent leakage of liquid between the downwardly depending wall and the client's neck. The auxiliary tightening means includes a "U"-shaped tunnel-defining member secured to an underside of the cape, and a drawstring disposed within a tunnel defined between the underside of the cape and the tunnel-defining member. The drawstring has free ends disposed outside of the tunnel so that the drawstring is tightenable by the client pulling upon its free ends.

Interlocking means for further interlocking the primary bowl to the secondary bowl is also provided. An upwardly opening notch is formed in a preselected upstanding inner side wall of the primary bowl and a downwardly opening notch is formed in a preselected inner side wall of the secondary bowl that depends downwardly from the secondary bowl. Thus, the upwardly opening notch engages the downwardly opening notch when the secondary bowl is placed in surmounting relation to the primary bowl.

It is a primary object of this invention to provide a portable hair cleaning device that obviates the need for a conventional sink and which therefore eliminates the discomfort associated with the use of such a sink during hair cleaning procedures.

Another important object is to provide a height-adjustable device that enables a client to sit comfortably on a chair or bed during a hair cleaning procedure.

Still another important object is to provide a means for protecting a client from liquids employed throughout a hair cleaning procedure.

An object closely related to the foregoing object is to provide a means under the control of the client that enables the client to tighten a cape around the client's neck to any degree of tightness needed to prevent liquid seepage past the cape.

Yet another object is to provide drainage means and collection tank means that collect used liquids during the hair cleaning process and which are easily emptied at the conclusion of the process.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be set forth in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
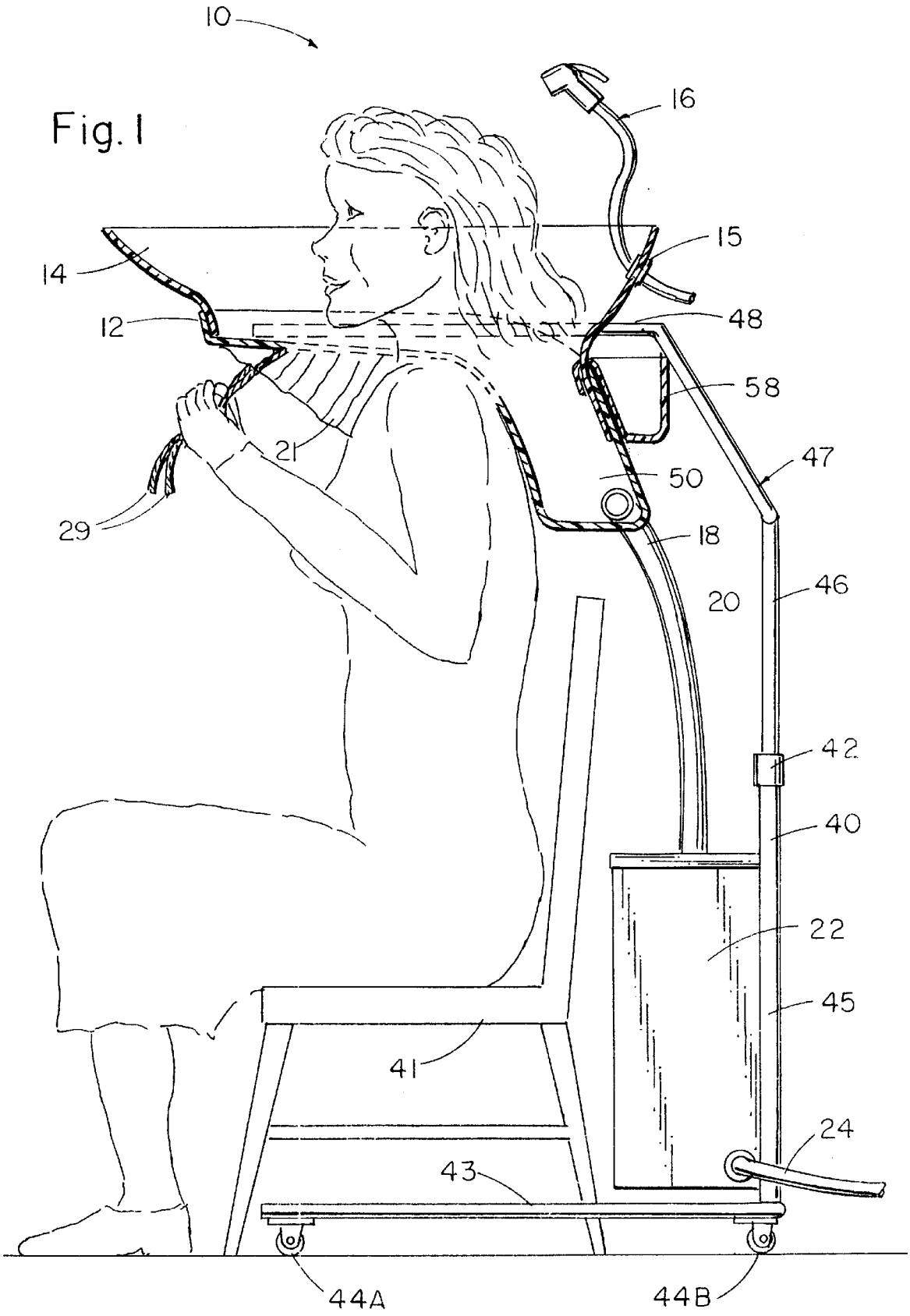
FIG. 1 is a side elevational view of an illustrative embodiment of the invention when in use.
Figure 2:
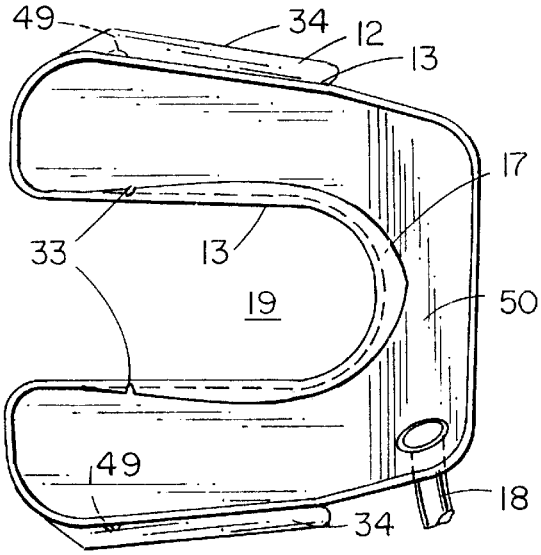
FIG. 2 is a top plan view of the primary bowl.

Referring now to FIG. 1, it will there be seen that an exemplary embodiment of the invention is denoted as a whole by the reference numeral 10. Primary bowl 12, as perhaps best understood in connection with FIG. 2, is generally U-shaped so that it sits atop a customer's shoulders when in use; the opening accommodates the user's neck as is clear from FIG. 1 Secondary bowl 14 sits atop and is supported by primary bowl 12. As will be understood more fully as this description proceeds, the weight of bowls 12 and 14 is also supported by structure other than the client's shoulders.

Figure 4:
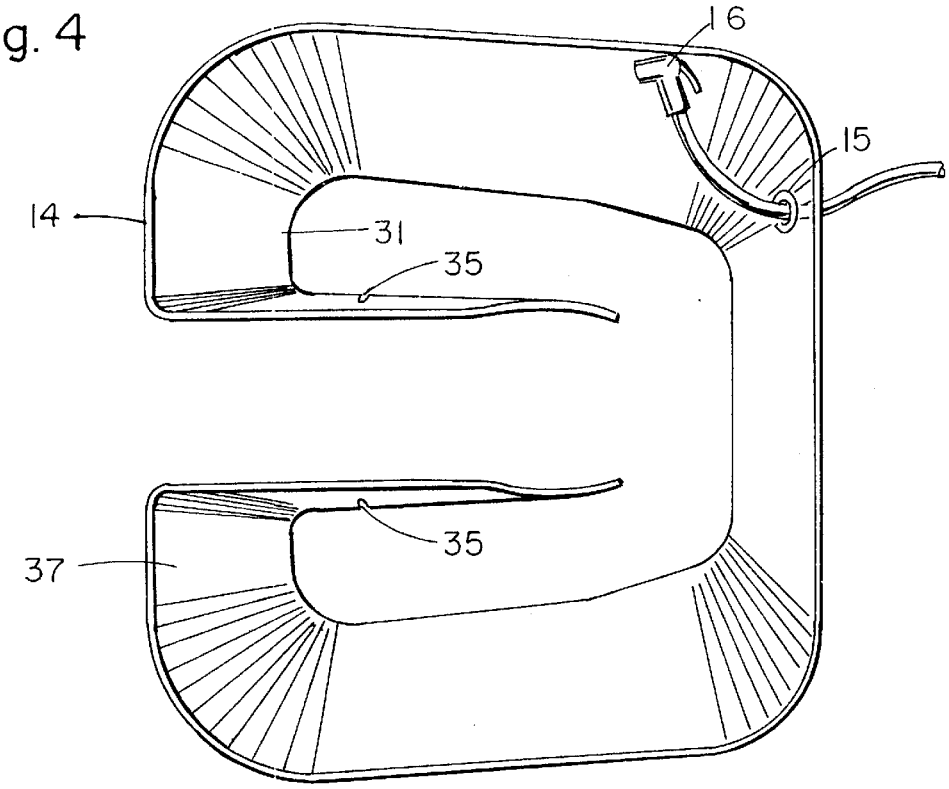
FIG. 4 is a top plan view of the secondary bowl.

Aperture 15 formed in a rear corner of secondary bowl 14, as best depicted in FIG. 4, receives a hose and spray nozzle assembly 16 that includes a trigger means for activation of liquid flow.

Molded outlet 18 is formed in a preselected rear corner of primary bowl 12 (see FIG. 2) and serves as a mount for the leading end of drain hose 20. The trailing end of drain hose 20 extends into drainage tank 22. Tank 22 may be lifted and manually emptied. However, in a preferred embodiment, drain hose 24, shown at the lower right corner of FIG. 1, extends from the bottom of drainage tank 22. An electrically-driven pump, not shown, in fluid communication with said drain hose 24, is employed to pump water out of drainage tank 22 through said drain hose 24.

Figure 3:
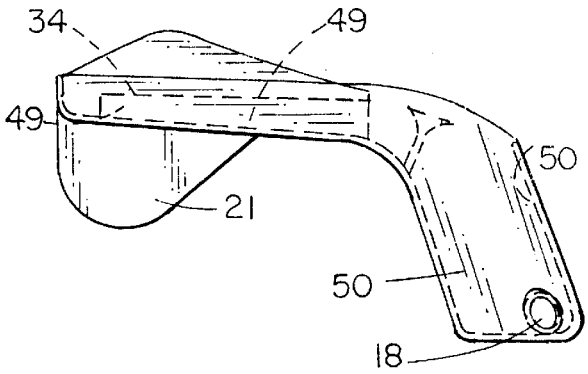
FIG. 3 is a side elevational view of the primary bowl.

As indicated in FIGS. 2 and 3, primary bowl 12 has a continuous upstanding wall 13 that is flared in the bight region of said bowl as denoted by the reference numeral 17 so that no sharp edge is presented to the back of the client's neck. A form-fitting foamed pad 21 depends from opposite sides of the neck opening for essentially the same reason.

Figure 5:
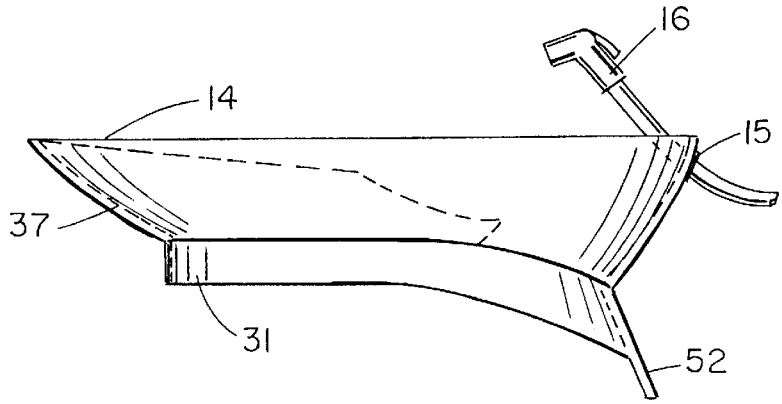
FIG. 5 is a side elevational view of the secondary bowl.

Bowls 12 and 14 are complementally formed so that secondary bowl 14 is snap fit onto primary bowl 12 when novel structure 10 is assembled. More particularly, a continuous convex rib 23 is formed into outer upstanding wall 13 of primary bowl 12. As best understood in connection with FIGS. 5, 7A, and 9, continuous concave rib 27 (FIGS. 7A and 9) is formed in wall 31 (FIGS. 5 and 7A) which depends from secondary bowl 14 along its opening. Convex rib 23 thus snaps into concave rib 27 when secondary bowl 14 is lowered onto primary bowl 12, holding said bowls together.

Further interlocking means for holding said bowls together includes a pair of upwardly opening notches 33 formed in primary bowl 12 at the forward end of the neck-receiving opening and a pair of downwardly opening notches 35 formed in the corresponding part of secondary bowl 12. Said notches mate with one another when said bowls are interconnected.

Other structural features include bottom wall 37 of secondary bowl 14 which is sloped downwardly as indicated in FIGS. 4, 5, 7A and 9 and a depending wall 52 located in the bight region of secondary bowl 14; said depending wall 52 extends into a reservoir 50 formed in the rear part of primary bowl 12. A paraphernalia tray 58 (FIG. 9) is detachably securable to the rear edge of primary bowl 12; it may be used to hold curlers, dyes, and the like.

Figure 6:
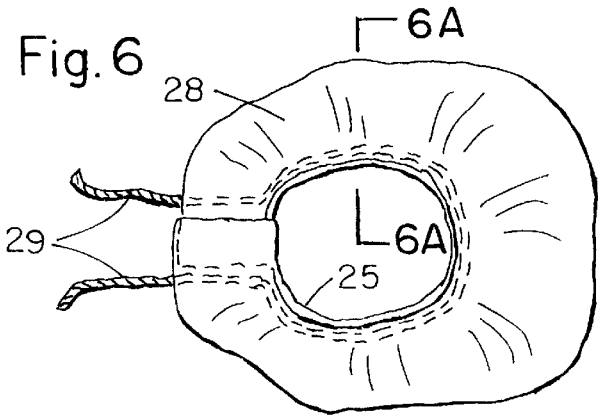
FIG. 6 is a top plan view of the novel cape.
Figure 6A:
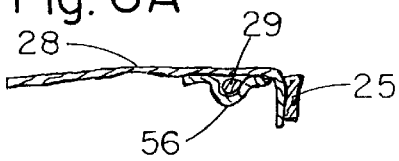
FIG. 6A is a sectional view taken along line 6A—6A in FIG. 6.
Figure 7:
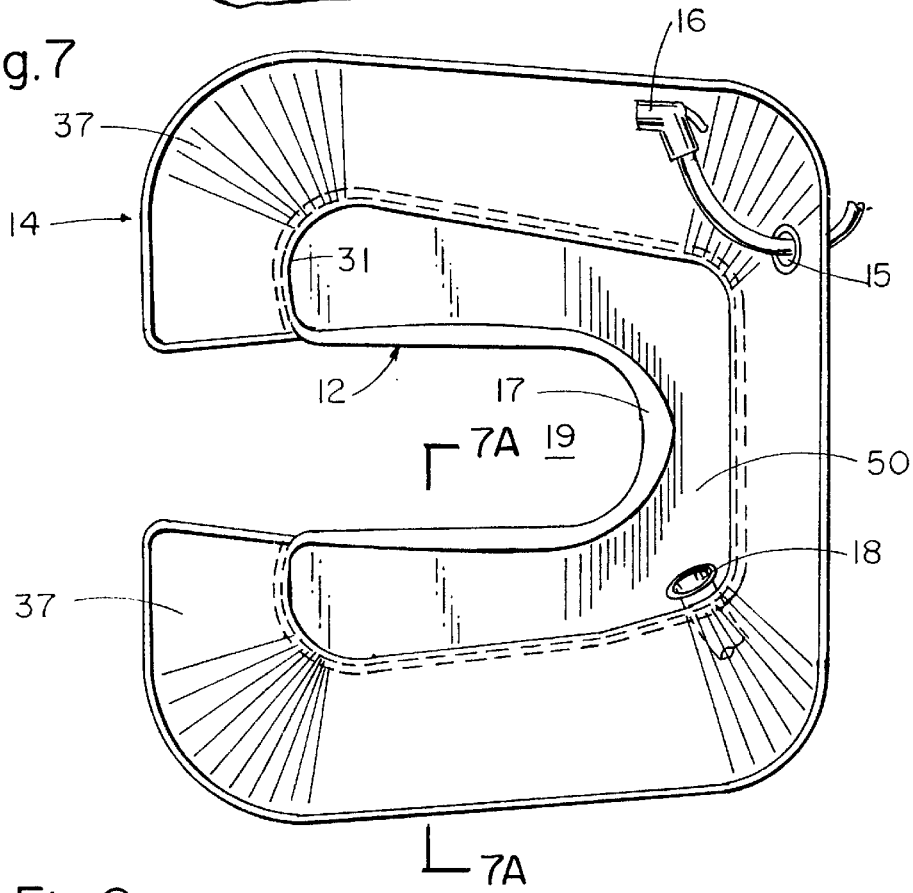
FIG. 7 is a top plan view of the bowls when interlocked with one another.
Figure 8:
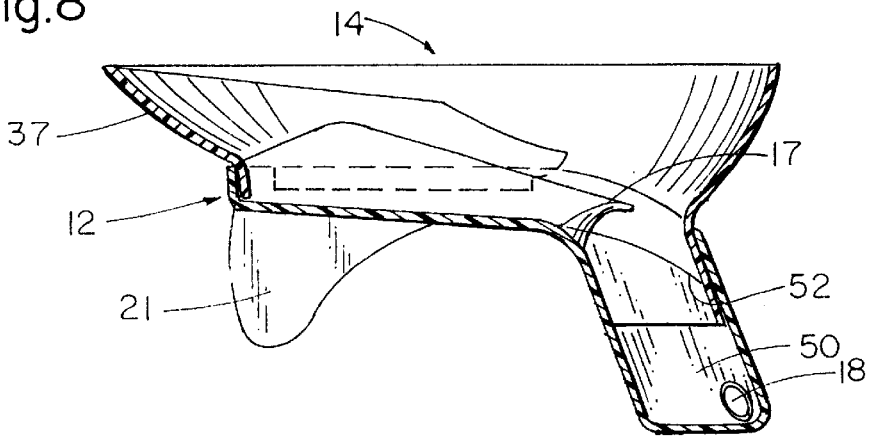
FIG. 8 is a side elevational view of the bowls when interlocked with one another.
Figures 7A, 9:
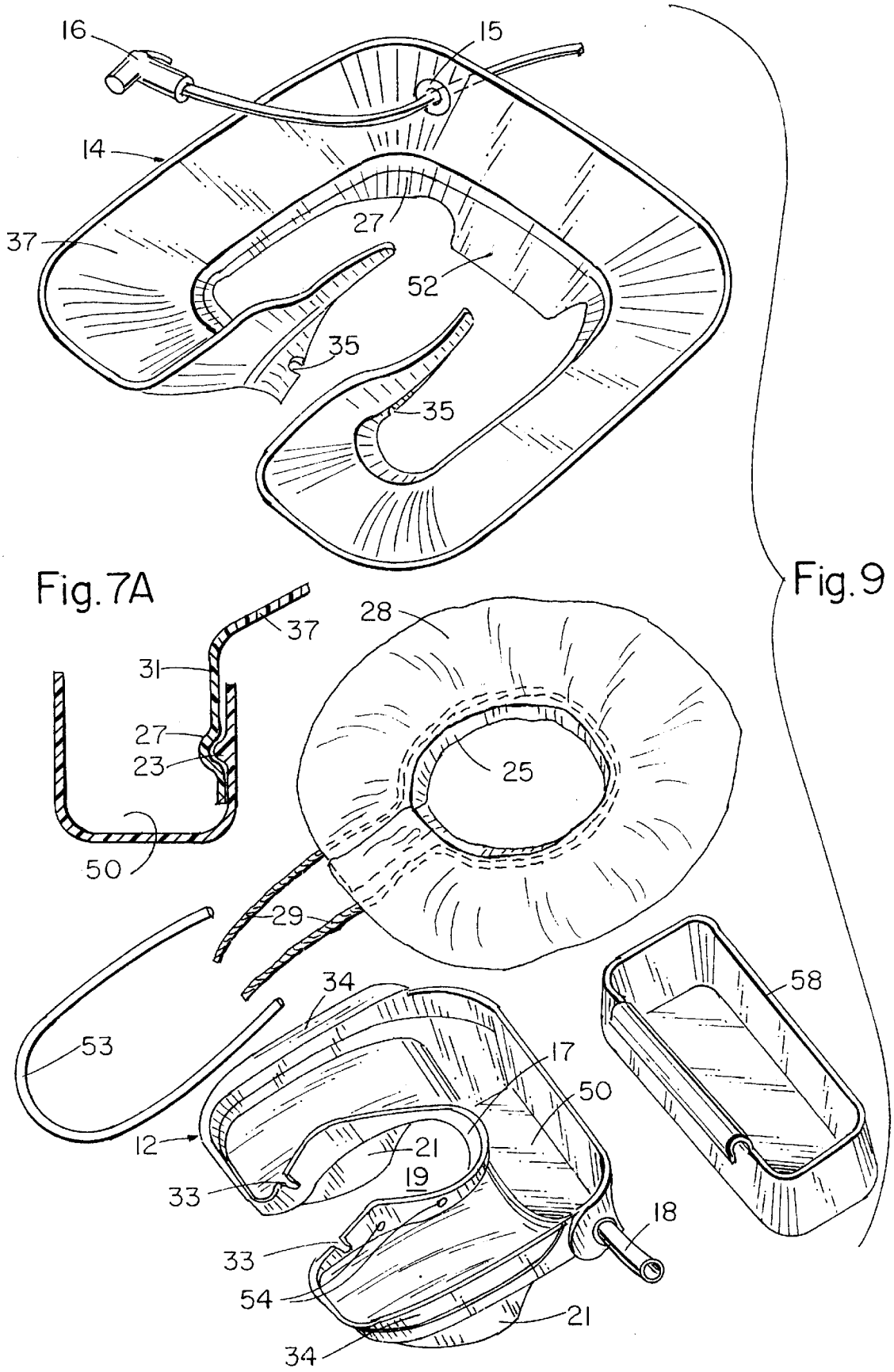
FIG. 7A is a sectional view taken along line 7A—7A in FIG. 7.
FIG. 9 is an exploded perspective view of the bowls, the cape, a paraphernalia tray, and a malleable padded wire.

FIGS. 6 and 6A depict a flexible, waterproof cape 28. The cape is fitted about the neck of a client prior to placing bowls 12 and 14 into position. Cape 28 includes a central neck-receiving opening surrounded by a flexible outlying part that overlies the client's shoulders. A radial slit is formed in said outlying part to grant access into said neck-receiving opening. As best depicted in FIG. 9, a wall depends from said opening, said wall overlying and snugly fitting against the client's neck when the cape is put on. A hook and loop fastener means 25 overlies said wall and is used as a belt means to snugly secure said wall in comfortable but sealing relation to the client's neck.

If a client feels that liquid is about to seep through the belted wall, means are provided whereby the client may tighten the grip of the wall to the extent desired. Essentially, the tightening means is a draw string 29 having free ends that may be pulled by the client to accomplish said tightening, as suggested in FIG. 1. The structure that enables such tightening is depicted in FIGS. 6, 6A, and in that part of FIG. 9 that includes malleable padded wire 53. After rolling a predetermined extent of the forward part of the joined cape onto said wire 53, said wire is fitted into detents 54, shown at the bottom of FIG. 9; said detents are formed in upstanding wall 13 of primary bowl 12. This secures cape 28 in a generally watertight manner to bowl 12. All but the opposite free ends of drawcord 29 is received within a channel or tunnel defined by a tunnel-forming member 56 that is secured to an underside of the cape (FIG. 6A). Tunnel-forming member 56 forms a "U"-shaped path around the neck opening and includes two parallel branches that extend forwardly from the neck opening to present the free ends of drawcord 29 to the client for pulling upon as needed.

Figure 10:
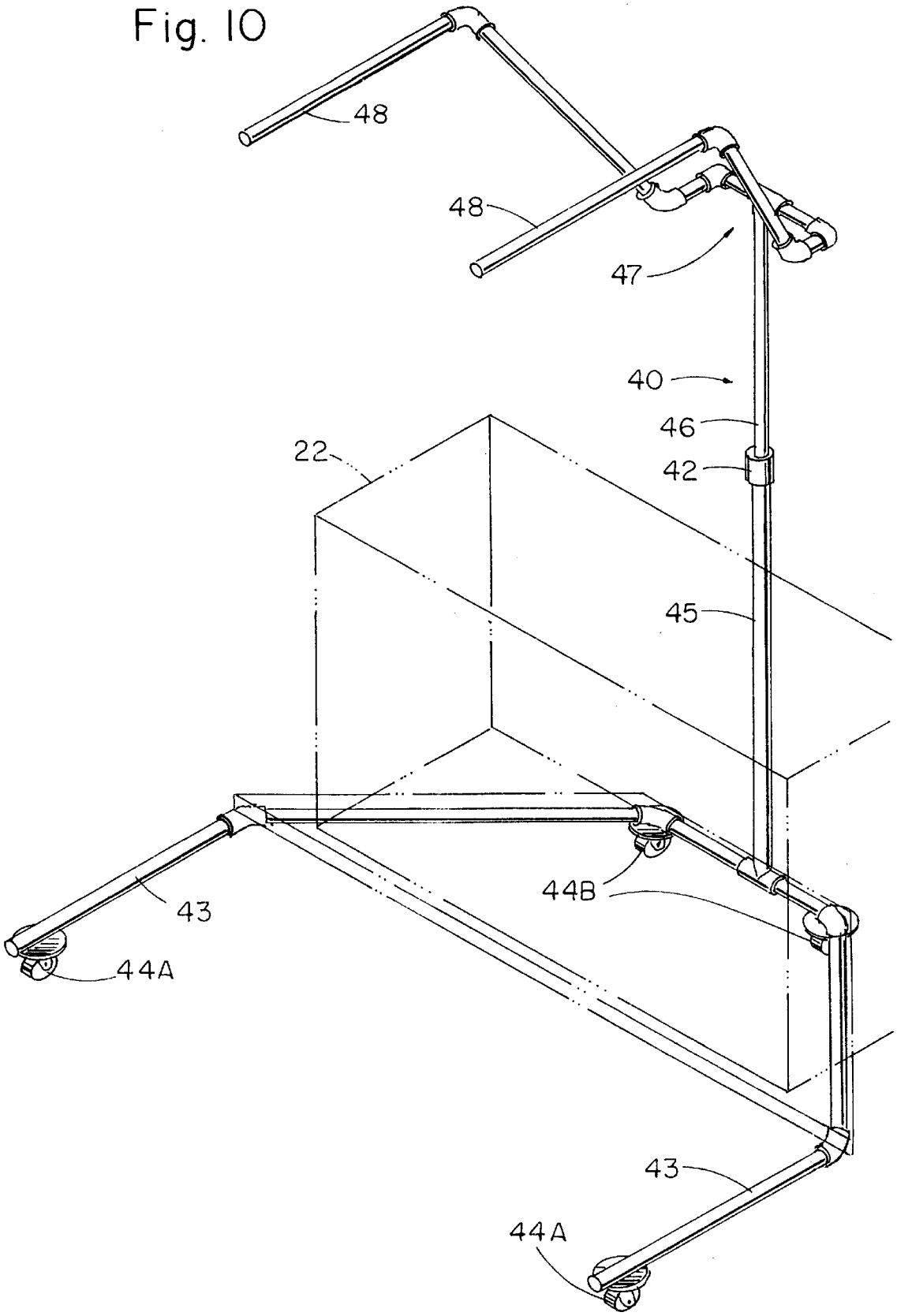
FIG. 10 is a perspective view of the portable stand and the waste fluid container.

Portable stand 40, best depicted in FIG. 10, partially surrounds chair 41 upon which a client sits during use of the novel structure. Stand 40 includes a base having transversely disposed arms 43, 43; the base as a whole is supported by caster wheels 44A, 44A, 44B, 44B. Collet 42 interconnects vertically disposed height adjustment members 45, 46 and enables vertical height adjustment of stand 40 so that it fits clients of differing heights. Horizontally disposed part 47 surmounts vertical member 46 and provides the support for transversely spaced apart parallel arms 48, 48 that provide support for primary bowl 12. More particularly, arms 48 slidingly extend into an inverted U-shaped channel 49 (FIG. 2) formed in outer walls 34 of bowl 12. This arrangement helps supports the weight of the bowls and also provides forward and rearward sliding adjustment of the bowls along the extent of arms 48, 48.

It is important to note that the novel device does not require the client to sit in a chair; its breadth enables the client or patient to sit up in a hospital bed instead, i.e., the transverse spacing between base members 43, 43 is sufficient to accommodate such a bed.

It will thus be seen that the objects set forth above, and those made apparent by the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A portable hair washing and shampooing device, comprising:

a primary "U"-shaped bowl positioned atop and at least partially supported by a client's shoulders;

a secondary "U"-shaped bowl disposed in surmounting relation to said primary bowl;

an opening formed in said secondary bowl;

an elongate liquid-supply hose extending through said opening, said liquid-supply hose having a trigger-operated spray nozzle connected to a free end thereof and said liquid-supply hose being in fluid communication with a remote source of liquid under pressure;

a stand having a pair of parallel arms for at least partially supporting said primary bowl; and a drainage tank in fluid communication with said primary bowl.

2. The portable device of claim 1, further comprising:

a cape means for protecting said client from liquid spillage;

said cape means having a neck-receiving central opening;

said cape means including a downwardly depending wall that encircles said neck opening; and a belt means that overlies said downwardly depending wall so that tightening of said belt means tightens said cape about the neck of said client.

3. A portable hair washing and shampooing device, comprising:

a stand having a base, a vertically disposed height adjustment means, and a pair of transversely disposed arms supported at a first end thereof by said height adjustment means;

a primary bowl having a general "U" shape that includes a neck-receiving opening;

said primary bowl including a bottom wall and upstanding side walls;

said upstanding side walls including inner side walls adjacent said neck-receiving opening and outer side walls disposed in spaced relation to said inner side walls;

said primary bowl being positioned atop a client's shoulders and atop said pair of transversely disposed arms and being at least partially supported by said arms;

a secondary bowl having a general "U" shape that includes a neck-receiving opening;

said secondary bowl having a bottom wall and upstanding side walls;

said upstanding side walls of said secondary bowl including inner side walls adjacent said neck-receiving opening of said secondary bowl and outer side walls that flare radially outwardly in spaced relation to said inner side walls of said secondary bowl;

said secondary bowl side walls having lower ends corresponding in shape to upper ends of said upstanding side walls of said primary bowl;

said secondary bowl positioned atop said primary bowl, said lower ends of said secondary bowl side walls adapted to releasably engage a free upper end of said upstanding side walls of said primary bowl;

an opening formed in said secondary bowl at a preselected location thereon;

a hand-held spray nozzle for applying a liquid to hair;

an elongate liquid supply hose providing fluid communication between a remote source of liquid under pressure and said hand-held spray nozzle, said elongate liquid supply hose extending through said opening;

a sump means formed in said primary bowl;

a drainage tank; and an elongate drainage hose disposed in fluid communication between said sump means and said drainage tank;

whereby liquid applied to the hair of a client whose neck is received within said neck-receiving opening is directed by said secondary bowl into said primary bowl and flows from said sump means of said primary bowl into said drainage tank;

whereby no sink is required to perform a hair washing or shampooing procedure;

whereby the client need not bend his or her neck during said procedure; and whereby a service provider performing said procedure need not bend over during said procedure.

4. The device of claim 3, further comprising:

a flexible, waterproof cape means worn about the neck of the client whose hair is to be cleaned;

said cape having an outlying part positioned in overlying relation to said client's shoulders;

said cape including a downwardly depending wall that encircles said client's neck; and a belt means that overlies said downwardly depending wall so that said belt means may be comfortably tightened about said client's neck.

5. The device of claim 4, further comprising:

attachment means for connecting an inner part of said cape to said primary bowl;

a plurality of detents formed in said inner upstanding side walls of said primary bowl at preselected locations adjacent said neck-receiving opening of said primary bowl;

a malleable padded wire that is snap fittingly engaged to said plurality of detents at spaced locations along its length;

said inner part of said cape being sandwiched between said upstanding side walls of said primary bowl and said malleable padded wire, said sandwiching providing said attachment means.

6. The device of claim 4, further comprising auxiliary tightening means enabling said client to further tighten said cape to prevent leakage of liquid between said downwardly depending wall and said client's neck.

7. The device of claim 6, wherein said auxiliary tightening means comprises:

a "U"-shaped tunnel-defining member secured to an underside of said cape;

a drawstring disposed within a tunnel defined between said underside of said cape and said tunnel-defining member;

said drawstring having free ends disposed outside of said tunnel so that said drawstring is tightenable by said client pulling upon said free ends.

8. The device of claim 3, further comprising:

interlocking means for interlocking said primary bowl and said secondary bowl to one another;

an upwardly opening notch formed in a preselected upstanding inner side wall of said primary bowl;

a downwardly opening notch formed in a preselected inner side wall of said secondary bowl that depends downwardly from said secondary bowl;

said upwardly opening notch engaging said downwardly opening notch when said secondary bowl is placed in surmounting relation to said primary bowl.

* * * * *